US006674056B2

(12) United States Patent
Lee

(10) Patent No.: US 6,674,056 B2
(45) Date of Patent: Jan. 6, 2004

(54) APPARATUS FOR UNIFORMING MICROWAVE AND HEATING SYSTEM USING THE SAME

(76) Inventor: Young Hee Lee, 4-203 Samsung Apartment, Taejen-dong, Bouk-gu, Tae-Gu 702-896 (KR)

( * ) Notice: Subject to any disclaimer, the term of this patent is extended or adjusted under 35 U.S.C. 154(b) by 28 days.

(21) Appl. No.: 10/130,203

(22) PCT Filed: Nov. 26, 2001

(86) PCT No.: PCT/KR01/02034

§ 371 (c)(1),
(2), (4) Date: May 14, 2002

(87) PCT Pub. No.: WO02/063926

PCT Pub. Date: Aug. 15, 2002

(65) Prior Publication Data

US 2003/0136779 A1 Jul. 24, 2003

(30) Foreign Application Priority Data

Feb. 5, 2001 (KR) ..... 2001/5424
Jul. 23, 2001 (KR) ..... 2001/44301

(51) Int. Cl.[7] ..... H05B 6/64

(52) U.S. Cl. ..... 219/745; 219/756; 219/728; 34/259; 333/227

(58) Field of Search ..... 219/745, 756, 219/746, 750, 728; 333/20, 227, 230; 34/259, 264

(56) References Cited

U.S. PATENT DOCUMENTS

| | | | | | |
|---|---|---|---|---|---|
| 3,461,260 | A | * | 8/1969 | Bremer | 219/745 |
| 4,616,119 | A | * | 10/1986 | Shin | 219/751 |
| 4,833,285 | A | * | 5/1989 | Okamoto et al. | 219/746 |
| 5,111,012 | A | * | 5/1992 | Hyun et al. | 219/757 |
| 5,698,128 | A | * | 12/1997 | Sakai et al. | 219/745 |
| 6,121,594 | A | * | 9/2000 | Joines et al. | 219/688 |

FOREIGN PATENT DOCUMENTS

| | | | | |
|---|---|---|---|---|
| DE | 42 30 522 | * | 3/1994 | 219/709 |
| JP | 02-226688 | * | 9/1990 | |

* cited by examiner

*Primary Examiner*—Philip H. Leung
(74) *Attorney, Agent, or Firm*—Dilworth & Barrese LLP.

(57) ABSTRACT

The apparatus for uniformly dispersing the microwave comprises a body including a plurality of reflective portions which are made of materials capable of reflecting the microwave and have the horizontal top surfaces and vertical side surfaces. The width of the plurality of reflective portions is set as 1/n times as large as a wavelength $\lambda_g$ of the microwave. The depth of each of the plurality of reflective portions may be set as a value obtained by multiplying the remainder, which is obtained by dividing the power of a natural number for the least primitive root of a prime number by the prime number, by the width of the reflective portion under a condition that a datum plane is defined by a height from the bottom surface corresponding to a value obtained by multiplying the width of the reflective portion by (prime number−1).

20 Claims, 10 Drawing Sheets

APPARATUS FOR UNIFORMING MICROWAVE AND HEATING SYSTEM USING THE SAME

TECHNICAL FIELD

The present invention relates to an apparatus for uniformly dispersing a microwave and a heating system employing the apparatus. More particularly, the present invention relates to an apparatus for uniformly dispersing a microwave which can uniformly disperse a microwave having a predetermined frequency outputted from a microwave generating means, and a heating system employing the apparatus for uniformly dispersing a microwave wherein a heating chamber of the heating system is defined by the apparatus and a uniform electric field is formed by uniformly dispersing the microwave in the heating chamber so as to evenly heat and dry an object to be heated that is contained in the heating chamber.

BACKGROUND ART

Generally, in a heating system such as a microwave oven for heating foodstuffs by using a microwave having a predetermined frequency or a microwave drying apparatus for drying wood, sludge, wastes, grain, rubber and the like, a microwave of 2.45 GHz or 915 MHz is generated by a microwave generating means using an oscillator such as a magnetron, and the generated microwave is guided to the interior of the heating chamber and heats and dries an object to be heated that is put in the heating chamber.

The microwave has a predetermined wavelength. For example, assuming that the frequency of the microwave is 2.45 GHz, the wavelength of the microwave is given as the following equation (1):

$$\lambda_g = c/f = (3\times10^8\ m/sec)/(2.45\times10^9\ Hz) \approx 12\ cm \quad (1)$$

where $\lambda_g$ is a wavelength of the microwave, c is the speed of light of $3\times10^8$ m/sec, and f is a frequency of the microwave.

In the heating system for heating and drying an object to be heated by using the microwave, all of the inner wall surfaces and the top and bottom surfaces of the heating chamber are usually planar.

Therefore, when the microwave outputted from the microwave generating means is guided into the heating chamber, the microwave is incident onto a planar surface 10, such as the inner wall surfaces and the top and bottom surfaces of the heating chamber, and then reflected by the planar surface 10 as shown in FIG. 1, so that the microwave is not uniformly dispersed but defectively reflected.

As the microwave is defectively reflected, the microwave is not uniformly distributed in the heating chamber. Thus, an object to be heated that is contained in the heating chamber is not evenly heated as a whole, so that the object is heated with the maximally and minimally heated points produced therein. That is, since the object is heated in such a manner that the maximally and minimally heated points are alternately produced therein at an interval of the wavelength of the microwave, the object is excessively heated at the maximally heated point, whereas it is not sufficiently heated at the minimally heated point. Thus, non-uniform heating of the object is produced.

In order to solve the above problems, a conventional heating system has a radio wave stirrer, such as a dispersion fan, mounted on the top of the heating chamber and causes the radio wave stirrer to be rotated so as to uniformly disperse the microwave and/or causes the object to be rotated, thereby evenly heating the object.

However, the rotation of either the radio wave stirrer or the object to be heated requires an additional driving motor for producing rotational force, a power transmitting mechanism for transmitting the rotational force from the driving motor, etc. This results in some problems including a complicated structure, increased production costs, higher consumption of electric power and the like.

DISCLOSURE OF INVENTION

An object of the present invention is to provide an apparatus for uniformly dispersing a microwave, which can uniformly disperse the microwave having a predetermined frequency.

Another object of the present invention is to provide a heating system employing the apparatus for uniformly dispersing the microwave, wherein the apparatus defines a heating chamber and uniformly disperses the microwave so as to evenly heat an object to be heated that is contained in the heating chamber.

In order to accomplish the above objects, an apparatus for uniformly dispersing the microwave according to the present invention comprises a body including a plurality of reflective portions which are made of materials capable of reflecting the microwave and have the horizontal top surfaces and vertical side surfaces. The width of the plurality of reflective portions can be set as 1/n (n=1, 2, 3, . . . ) times as large as a wavelength $\lambda_g$ of the microwave. More preferably, the width is set as 1/4n (for example, $\lambda_g/4$, $\lambda_g/8$, $\lambda_g/12$, . . . ) times as large as the wavelength $\lambda_g$ of the microwave.

Further, the depth of each of the plurality of reflective portions may be set as a value obtained by multiplying the remainder, which is obtained by dividing the power of a natural number for the least primitive root of a prime number by the prime number, by the width of the reflective portion under the condition that a datum plane is defined by a height from the bottom surface corresponding to a value obtained by multiplying the width of the reflective portion by (prime number−1). Alternatively, the depth of each reflective portion may be set as a value obtained by multiplying the remainder, which is obtained by dividing a square of a natural number by a prime number, by the width W of the reflective portion under the condition that the datum plane is defined by the bottom surface.

Moreover, in the heating system according to the present invention, the top, bottom and inner wall surfaces of the heating chamber are formed by continuously and repeatedly coupling the aforementioned bodies. The body is also additionally installed on an inner surface of a door of the heating system. The microwave generated from the microwave generating means and guided into the heating chamber is uniformly dispersed in the heating chamber by the bodies to form a uniform electric field of the microwave, thereby evenly heating and drying the object to be heated.

BRIEF DESCRIPTION OF DRAWINGS

FIGS. 5*a* and 5*b* are views showing an example of a heating system having a heating chamber formed by bodies of the apparatus for uniformly dispersing the microwave according to the present invention, wherein FIG. 5*a* is a perspective view of the heating system with a door thereof opened and FIG. 5*b* is a sectional view of the heating system.

FIGS. 7*a* and 7*b* are views showing another example of the heating system having an object accommodating chamber installed in the heating chamber formed by the bodies of the apparatus according to the present invention, wherein FIG. 7*a* is a perspective view of the heating system with the door opened and FIG. 7*b* is a sectional view of the heating system.

BEST MODE FOR CARRYING OUT THE INVENTION

Hereinafter, an apparatus for uniformly dispersing a microwave and a heating system employing the apparatus according to the present invention will be explained in detail with reference to the accompanying drawings, particularly FIGS. 2 to 8.

Figure 1:
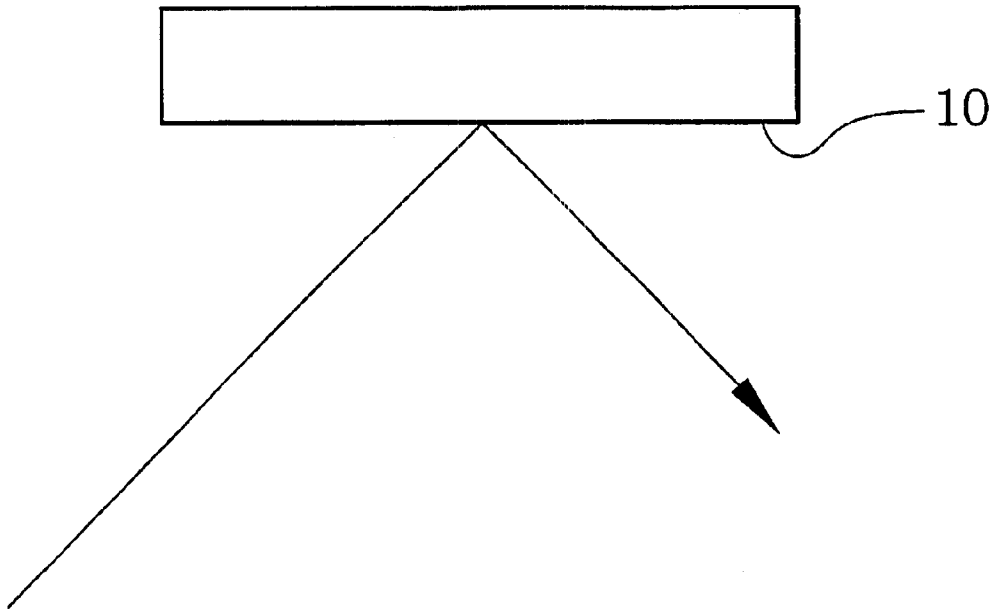
FIG. 1 is an explanatory view illustrating reflection characteristics in a case where a microwave is incident onto a planar surface.
Figure 2:
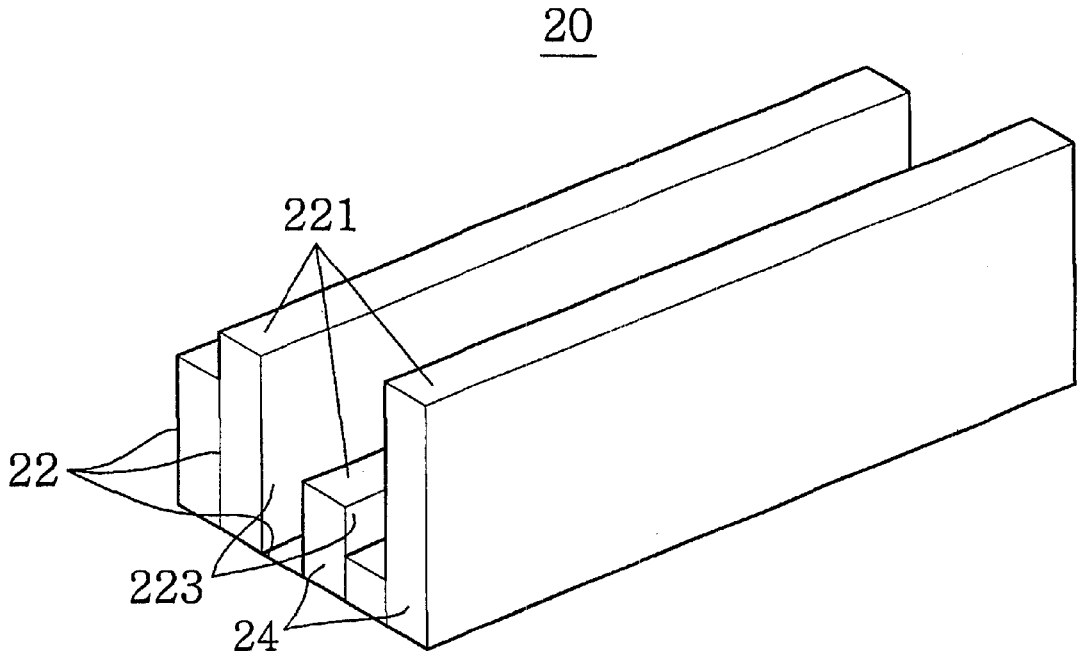
FIG. 2 is a perspective view showing the constitution of an apparatus for uniformly dispersing a microwave according to the present invention.

FIG. 2 is a perspective view showing the constitution of the apparatus for uniformly dispersing the microwave according to the present invention. Here, reference numeral 20 designates a body of the apparatus for uniformly dispersing the microwave according to the present invention. The body 20 is made of materials which can reflect the microwave. For example, the body 20 can be made of an aluminum sheet. Alternatively, the body 20 may be made of heat-resistant synthetic resins and then coated with reflective materials such as aluminum which can reflect the microwave.

The body 20 is constructed in the form of a dispersing unit which was researched and published by Manfred R. Schroeder in Germany and Murray Hill of AT&T Bell Lab. That is, the body 20 includes a plurality of reflective portions 22.

Each of the reflective portions 22 has the horizontal top surface 221 and vertical side surfaces 223.

Further, all the top surfaces 221 of the reflective portions 22 are constructed to have an identical width W. For example, the width W of the top surfaces 221 of the reflective portions 22 can be set as 1/n (n=1, 2, 3, . . . ) times as large as a wavelength $\lambda_g$ of the microwave. More preferably, the width W is set as 1/4n (for example, $\lambda_g/4$, $\lambda_g/8$, $\lambda_g/12$, . . . ) times as large as the wavelength $\lambda_g$ of the microwave.

Further, the top surfaces 221 of the reflective portions 22 are constructed to have different depths $D_k$ obtained under the condition that a datum plane is defined by a height from the bottom surface thereof corresponding to a value obtained by multiplying the width of the reflective portion by (prime number−1).

For example, the depths $D_k$ of the top surfaces 221 of the reflective portions 22 are set as values obtained by multiplying the remainders, which are obtained by dividing the powers of a natural number n for the least primitive root g of a prime number p by the prime number p, by the width W of the reflective portions, according to the following equations (2-1) and (2-2):

$$D=g^n \text{ module } p \tag{2-1}$$

$$D_k=D\cdot W \tag{2-2}$$

where p is a prime number, g is the least primitive root of the prime number p, n is a natural number such as 1, 2, 3, . . . , and $g^n$ module p means the remainder obtained by dividing $g^n$ by p.

Assuming that the prime number p is 7 and the least primitive root g of the prime number p is 3, the depths $D_k$ ($D_1$~$D_6$) of the top surfaces 221 (221*a*~221*f*) of the plurality of reflective portions 22 are set with respect to the datum plane, as follows:

| | | |
|---|---|---|
| $3^1$ = 3; | 3/7 = quotient: 0, | remainder: 3 |
| $3^2$ = 9; | 9/7 = quotient: 1, | remainder: 2 |
| $3^3$ = 27; | 27/7 = quotient: 3, | remainder: 6 |
| $3^4$ = 81; | 81/7 = quotient: 11, | remainder: 4 |
| $3^5$ = 243; | 243/7 = quotient: 34, | remainder: 5 |
| $3^6$ = 729; | 729/7 = quotient: 104, | remainder: 1 |

Figure 3:
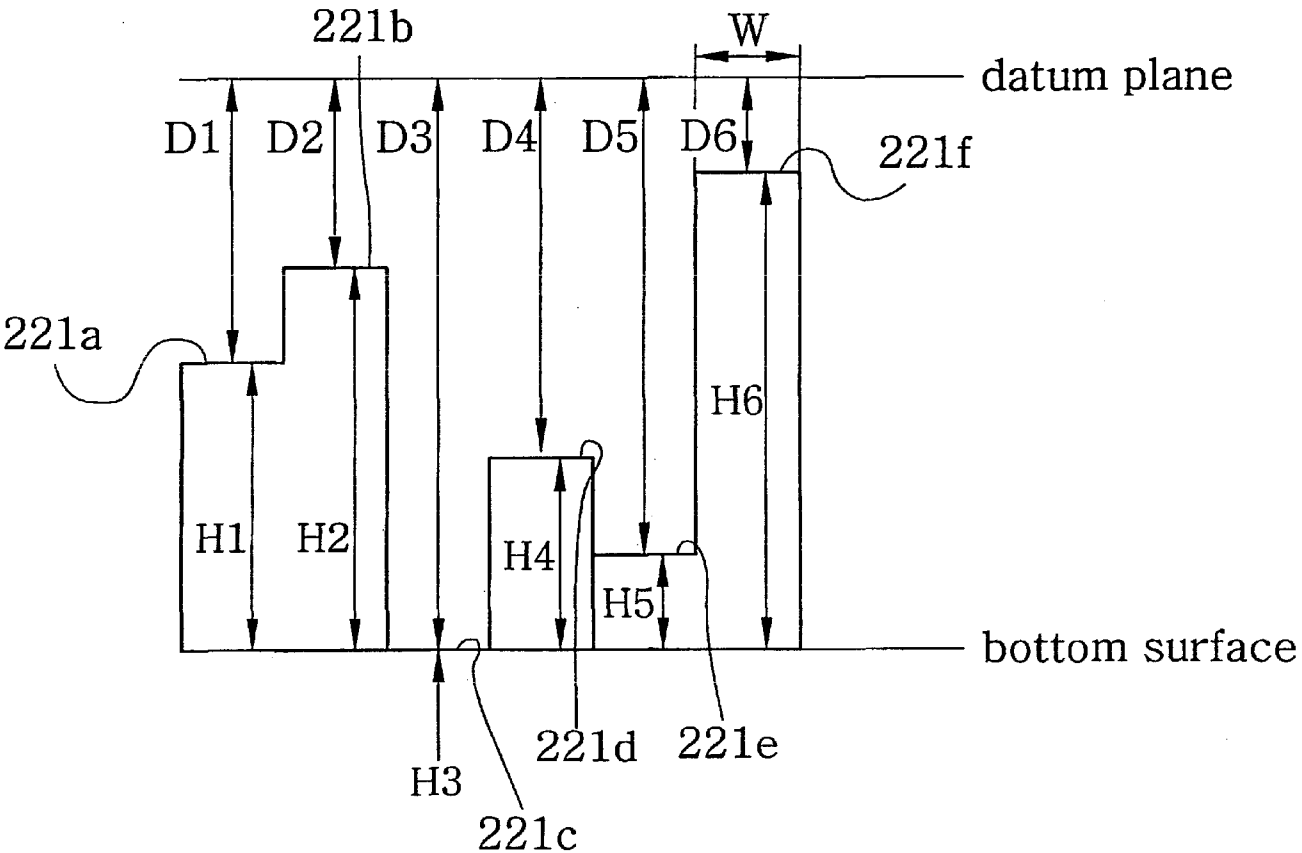
FIG. 3 is a side view showing the constitution of the apparatus for uniformly dispersing the microwave according to the present invention.

That is, as shown in FIG. 3, the top surfaces 221*a*~221*f* of the reflective portions 22 are constructed to have respective depths $D_k$ ($D_{1\sim D6}$) of 3W, 2W, 6W, 4W, 5W and 1W from the datum plane which is defined by a height of 6W obtained by multiplying the width W of the reflective portions by 6 to which 7 of the prime number p minus 1 is equal.

Table 1 below shows the results of such calculation.

TABLE 1

| | Depth from the datum plane | | | | | |
|---|---|---|---|---|---|---|
| n | p = 5, g = 2 | p = 7, g = 3 | p = 11, g = 2 | p = 13, g = 2 | p = 17, g = 3 | p = 19, g = 2 |
| 1 | 2W | 3W | 2W | 2W | 3W | 2W |
| 2 | 4W | 2W | 4W | 4W | 9W | 4W |
| 3 | 3W | 6W | 8W | 8W | 10W | 8W |
| 4 | 1W | 4W | 5W | 3W | 13W | 16W |
| 5 | | 5W | 10W | 6W | 5W | 13W |
| 6 | | 1W | 9W | 12W | 15W | 7W |
| 7 | | | 7W | 10W | 11W | 14W |
| 8 | | | 3W | 9W | 16W | 9W |

TABLE 1-continued

| | Depth from the datum plane | | | | | |
|---|---|---|---|---|---|---|
| n | p = 5, g = 2 | p = 7, g = 3 | p = 11, g = 2 | p = 13, g = 2 | p = 17, g = 3 | p = 19, g = 2 |
| 9 | | | 6W | 5W | 14W | 18W |
| 10 | | | 1W | 10W | 8W | 17W |
| 11 | | | | 7W | 7W | 15W |
| 12 | | | | 1W | 4W | 11W |
| 13 | | | | | 12W | 3W |
| 14 | | | | | 2W | 6W |
| 15 | | | | | 6W | 12W |
| 16 | | | | | 1W | 5W |
| 17 | | | | | | 10W |
| 18 | | | | | | 1W |

The depths $D_k$ ($D_1$~$D_6$) of the top surfaces 221 (221*a*~221*f*) of the reflective portions 22 can be converted into heights $H_k$ ($H_1$~$H_6$) from the bottom surface as the datum plane as follows:

| | | |
|---|---|---|
| $3^1 = 3$; | 3/7 = quotient: 0, | remainder: 3 → 6 − 3 = 3 |
| $3^2 = 9$; | 9/7 = quotient: 1, | remainder: 2 → 6 − 2 = 4 |
| $3^3 = 27$; | 27/7 = quotient: 3, | remainder: 6 → 6 − 6 = 0 |
| $3^4 = 81$; | 81/7 = quotient: 11, | remainder: 4 → 6 − 4 = 2 |
| $3^5 = 243$; | 243/7 = quotient: 34, | remainder: 5 → 6 − 5 = 1 |
| $3^6 = 729$; | 729/7 = quotient: 104, | remainder: 1 → 6 − 1 = 5 |

That is, the heights $H_k$ ($H_1$~$H_6$) of the top surfaces 221 (221*a*~221*f*) from the bottom surface as the datum plane are determined as 3W, 4W, 0, 2W, 1W and 5W.

Moreover, the heights $H_k$ of the top surfaces 221 of the reflective portions 22 may be set in accordance with other methods in addition to the above method. For instance, each of the heights $H_k$ of the top surfaces 221 of the reflective portions 22 from the bottom surface as the datum plane may be set as a value obtained by multiplying the remainder, which is obtained by dividing a square of 0 and the natural number by the prime number p, by the width of the reflective portions, according to the following equations (3-1) and (3-2):

$$H=N^2 \text{module } p \tag{3-1}$$

$$H_K=H\sim W \tag{3-2}$$

where N is 0, 1, 2, . . . , p is the prime number, and $N^2$ module p means the remainder obtained by dividing $N^2$ by p.

For example, in a case where the prime number p is 5, the heights $H_K$ of the top surfaces 221*a*~221*f* of the reflective portions 22 are set as follows:

| | | |
|---|---|---|
| $0^2 = 0$; | 0/5 = quotient: 0, | remainder: 0 |
| $1^2 = 1$; | 1/5 = quotient: 0, | remainder: 1 |
| $2^2 = 4$; | 4/5 = quotient: 0, | remainder: 4 |
| $3^2 = 9$; | 9/5 = quotient: 1, | remainder: 4 |
| $4^2 = 16$; | 16/5 = quotient: 3, | remainder: 1 |
| $5^2 = 25$; | 25/5 = quotient: 5, | remainder: 0 |

The heights H1~H6 of the top surfaces 221*a*~221*f* of the reflective portions 22 becomes 0, 1W, 4W, 4W, 1W and 0, which are obtained by multiplying the respective remainders by the width W of the reflective portions, from the bottom surface.

Table 2 below shows the results of such calculation.

TABLE 2

| | P | | | | | | |
|---|---|---|---|---|---|---|---|
| N | 5 | 7 | 11 | 13 | 17 | 19 | 23 |
| 0 | 0 | 0 | 0 | 0 | 0 | 0 | 0 |
| 1 | 1W | 1W | 1W | 1W | 1W | 1W | 1W |
| 2 | 4W | 4W | 4W | 4W | 4W | 4W | 4W |
| 3 | 4W | 2W | 9W | 9W | 9W | 9W | 9W |
| 4 | 1W | 2W | 5W | 3W | 16W | 16W | 16W |
| 5 | 0 | 4W | 3W | 12W | 8W | 6W | 2W |
| 6 | | 1W | 3W | 10W | 2W | 17W | 13W |
| 7 | | 0 | 5W | 10W | 15W | 11W | 3W |
| 8 | | | 9W | 12W | 13W | 7W | 18W |
| 9 | | | 4W | 3W | 13W | 5W | 12W |
| 10 | | | 1W | 9W | 15W | 5W | 8W |
| 11 | | | 0 | 4W | 2W | 7W | 6W |
| 12 | | | | 1W | 8W | 11W | 6W |
| 13 | | | | 0 | 16W | 17W | 8W |
| 14 | | | | | 9W | 6W | 12W |
| 15 | | | | | 4W | 16W | 18W |
| 16 | | | | | 1W | 9W | 3W |
| 17 | | | | | 0 | 4W | 13W |
| 18 | | | | | | 1W | 2W |
| 19 | | | | | | 0 | 16W |
| 20 | | | | | | | 9W |
| 21 | | | | | | | 4W |
| 22 | | | | | | | 1W |
| 23 | | | | | | | 0 |

In these ways, the body 20 of the apparatus for uniformly dispersing the microwave according to the present invention is constructed to include the plurality of reflective portions 22 having the width W proportional to the wavelength of the microwave and the different depths $D_K$ or heights $H_K$ obtained according to the equations (2-1), (2-2); or (3-1), (3-2).

Figure 4:
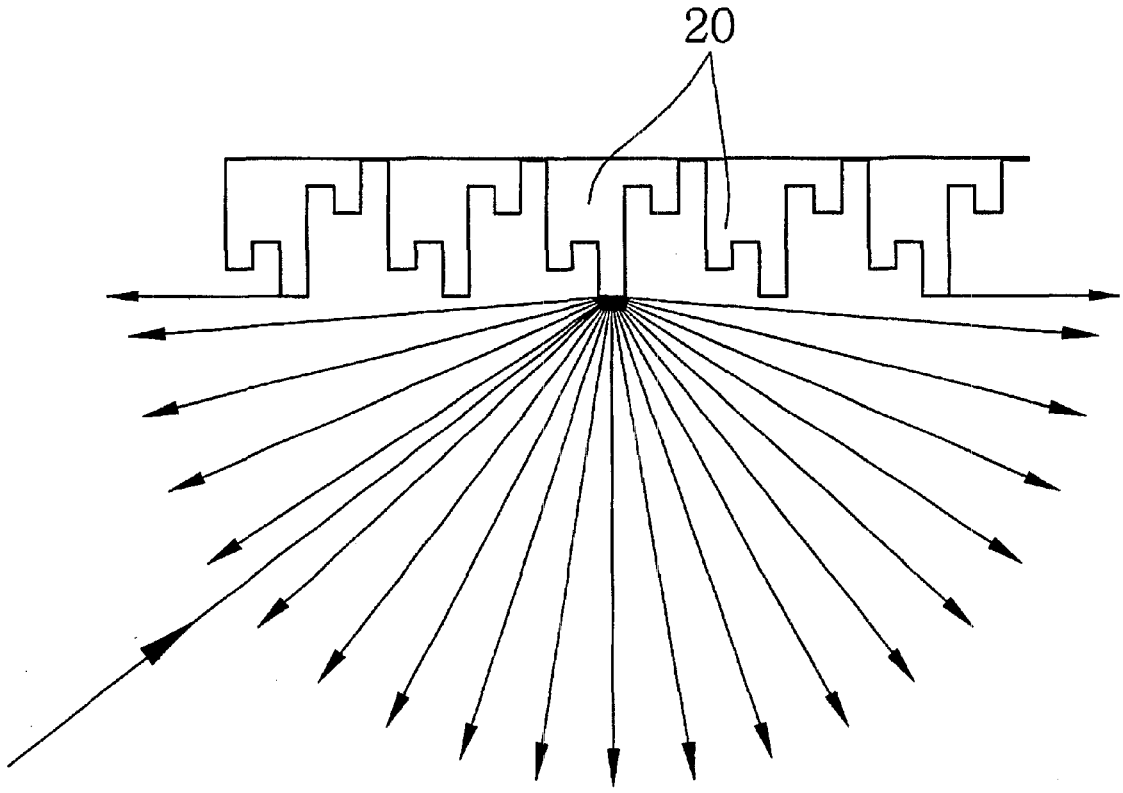
FIG. 4 is an explanatory view illustrating reflection characteristics in a case where the microwave is incident onto the apparatus for uniformly dispersing the microwave according to the present invention.

The body 20 of the apparatus for uniformly dispersing the microwave according to the present invention is fabricated and used in such a manner that the plurality of bodies 20 shown in FIG. 2 can be continuously coupled with each other. When the microwave is incident onto the bodies 20 as shown in FIG. 4, the bodies 20 reflect the microwave to be uniformly dispersed, thereby forming a uniform electric field.

Therefore, the object to be heated can be evenly heated and dried with the uniformly dispersed microwave even while the object remains stationary without being rotated.

On the other hand, when the body 20 is installed on a wall surface of the heating system or the like, if the body 20 has a length in such a degree that both the right and left ends of the body are not in close contact with the top and bottom surfaces and openings are generated therebetween, there is a risk in that the microwave leaks through the openings between both the ends of the body 20 and the top and bottom surfaces. Thus, in this case, it is preferable that both the ends of the body 20 be sealed with partitions 24 made of the same materials as the body 20 to prevent the microwave from leaking.

The aforementioned embodiment has been described in connection with the body 20 having six reflective portions 22. The number of the reflective portions 22 is not limited to a specific number. A prime number is properly selected according to the size etc. of the heating chamber of the heating system in which the body 20 will be installed, and a plurality of reflective portions 22 according to the selected prime number are provided.

Even in this case, the width W of the reflective portions 22 constituting the body 20 can be set as 1/n (n=1, 2, 3, . . . ) times as large as the wavelength $\lambda_g$ of the microwave in the same way of the aforementioned embodiment. More preferably, the width W is set as 1/4n (i.e., $\lambda_g/4$, $\lambda_g/8$, $\lambda_g/12$, . . . ) times as large as the wavelength $\lambda_g$ of the microwave.

When the heating chamber of the heating system is formed by the body 20 of the apparatus for uniformly dispersing the microwave according to the present invention, the microwave is uniformly dispersed to form a uniform electric field within the heating chamber.

Figure 5A:
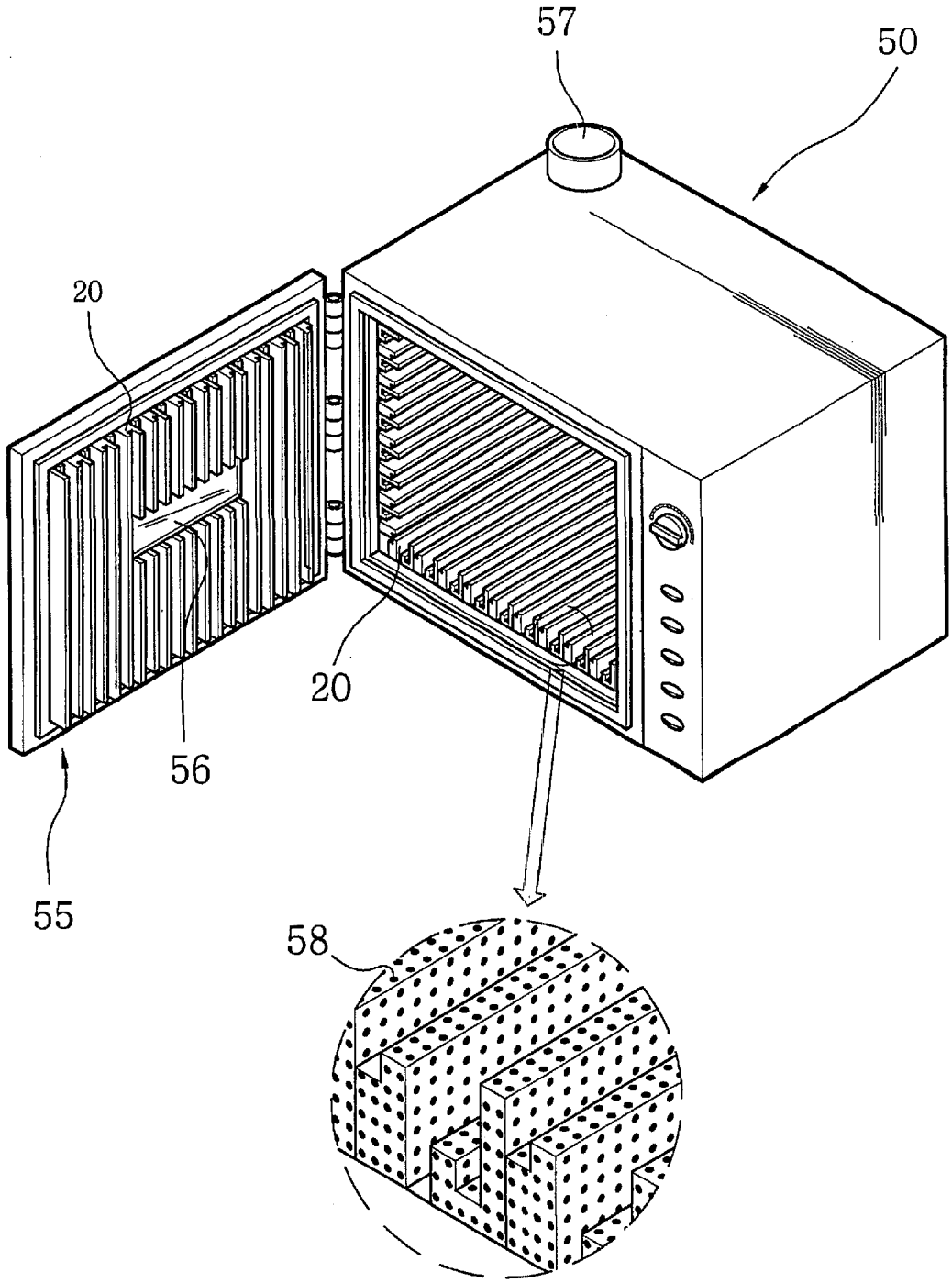
Figure 5B:
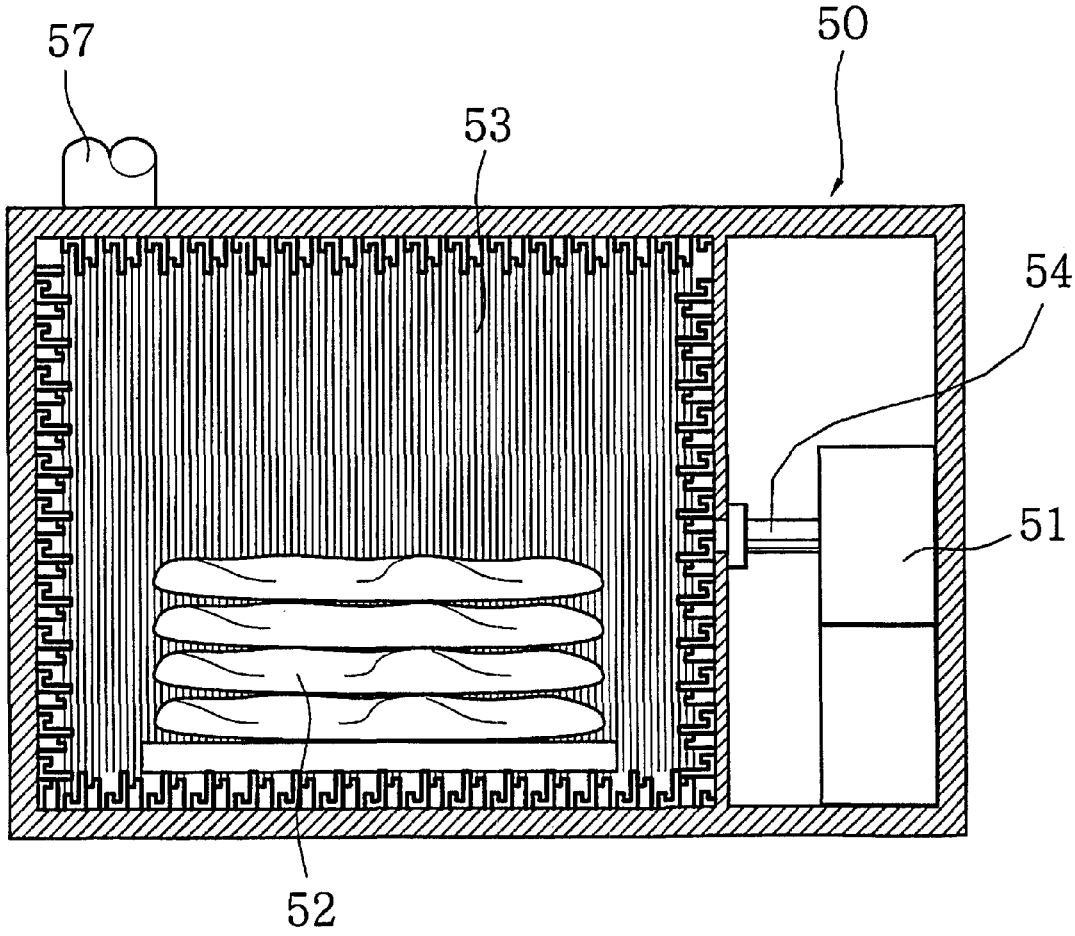

FIGS. 5*a* and 5*b* are views showing an example of the heating system having the heating chamber formed by the bodies of the apparatus for uniformly dispersing the microwave according to the present invention. FIG. 5*a* is a perspective view of the heating system with a door thereof opened and FIG. 5*b* is a sectional view of the heating system.

Reference numeral 50 is a main body of the heating system. A microwave generating means 51 for generating the microwave by using an oscillator such as a magnetron is provided on one side of the interior of the main body 50. A heating chamber 53 for heating and drying an object to be heated 52 by using the microwave generated from the microwave generating means 51 is provided on the other side of the main body 50.

A microwave guiding means 54 such as a waveguide for guiding the microwave generated from the microwave generating means 51 into the heating chamber 53 is interposed between the microwave generating means 51 and the heating chamber 53.

The top, bottom and inner peripheral surfaces of the heating chamber 53 are constructed by continuously and repeatedly installing the bodies 20 of the apparatus for uniformly dispersing the microwave. A door 55 is provided at the front face of the heating chamber 53 so that an operator can open and close the heating chamber 53. The bodies 20 are also continuously and repeatedly installed on an inner surface of the door 55 while keeping only a viewing window 56 uncovered. At this time, the top surfaces 221 of the reflective portions 22 of the bodies 20 are installed to be directed toward the interior of the heating chamber 53.

The bodies 20 constituting the top, bottom and inner peripheral surfaces of the heating chamber 53 are formed with a plurality of vent holes 58 at a predetermined interval so that water vapor, which is generated when the object 52 is heated and dried by the microwave under the condition that the door 55 is closed and the heating chamber 53 is hermetically sealed, is sucked into the vent holes and discharged through an exhausting port 57.

At this time, since the microwave should not leak through the vent holes 58, it is preferable that the vent holes 58 be sized to have radii sufficient to prevent the microwave from leaking therethrough, for example, within a range of 0.6~0.8 mm.

In a case where the object 52 is intended to be heated and dried using the heating system of the present invention constructed as such, the door 55 is first opened and the object 52 is put in the heating chamber 53. Then, the door 55 is closed and the heating system is operated.

Subsequently, the microwave generating means 51 is activated to generate the microwave and the generated microwave is guided through the microwave guiding means 54 into the heating chamber 53.

The microwave guided into the heating chamber 53 is reflected and uniformly dispersed by the reflective portions 22 of the bodies 20 installed on the top, bottom and inner peripheral surfaces of the heating chamber 53 and on the inner surface of the door 55. The microwave in the heating chamber 53 forms a uniform electric field so that the object 52 is evenly heated and dried.

At this time, water vapor, smell and the like generated while heating and drying the object 52 are sucked through the vent holes 58 formed in the bodies 20 and then discharged to the exterior through the exhausting port 57.

Figure 6A:
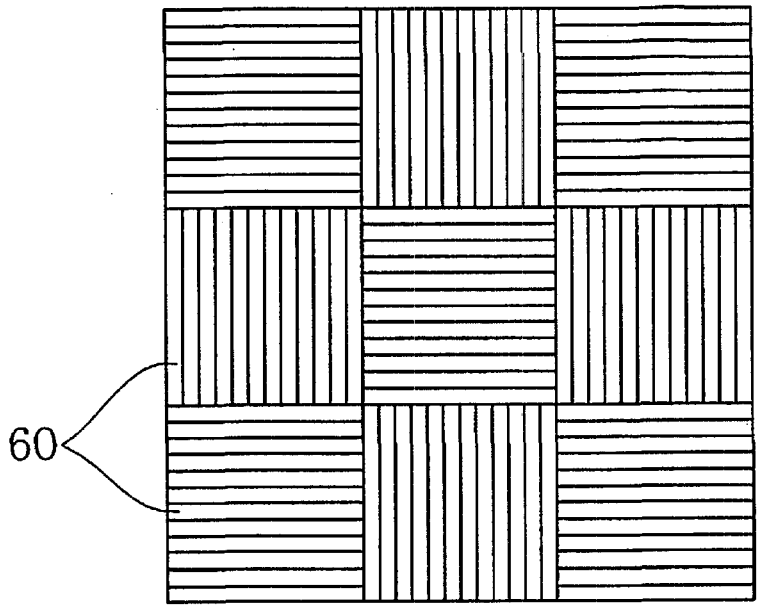
FIGS. 6*a* and 6*b* are views showing examples of arrangement of the bodies of the apparatus in the heating system according to the present invention.
Figure 6B:
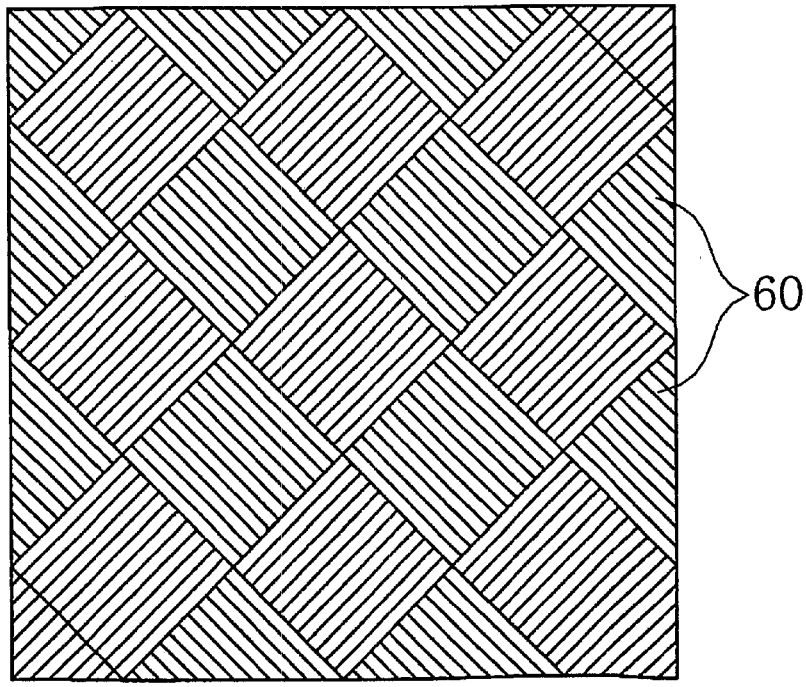

FIGS. 6*a* and 6*b* are views showing examples of arrangement of the bodies of the apparatus in the heating system according to the present invention. As shown in the figures, a fundamental body 60 substantially in the form of a square is constructed by continuously forming several bodies 20 having a predetermined length. As shown in FIG. 6*a*, a plurality of the fundamental bodies 60 can be arranged in zigzags such that the reflective portions 22 are placed vertically and horizontally. The fundamental bodies 60 constructed as such can be installed on the top, bottom and inner peripheral surfaces of the heating chamber 53 and on the inner surface of the door 55.

Further, the plurality of the fundamental bodies 60 may be arranged in zigzags such that the reflective portions 22 are positioned at a predetermined angle.

Figure 7A:
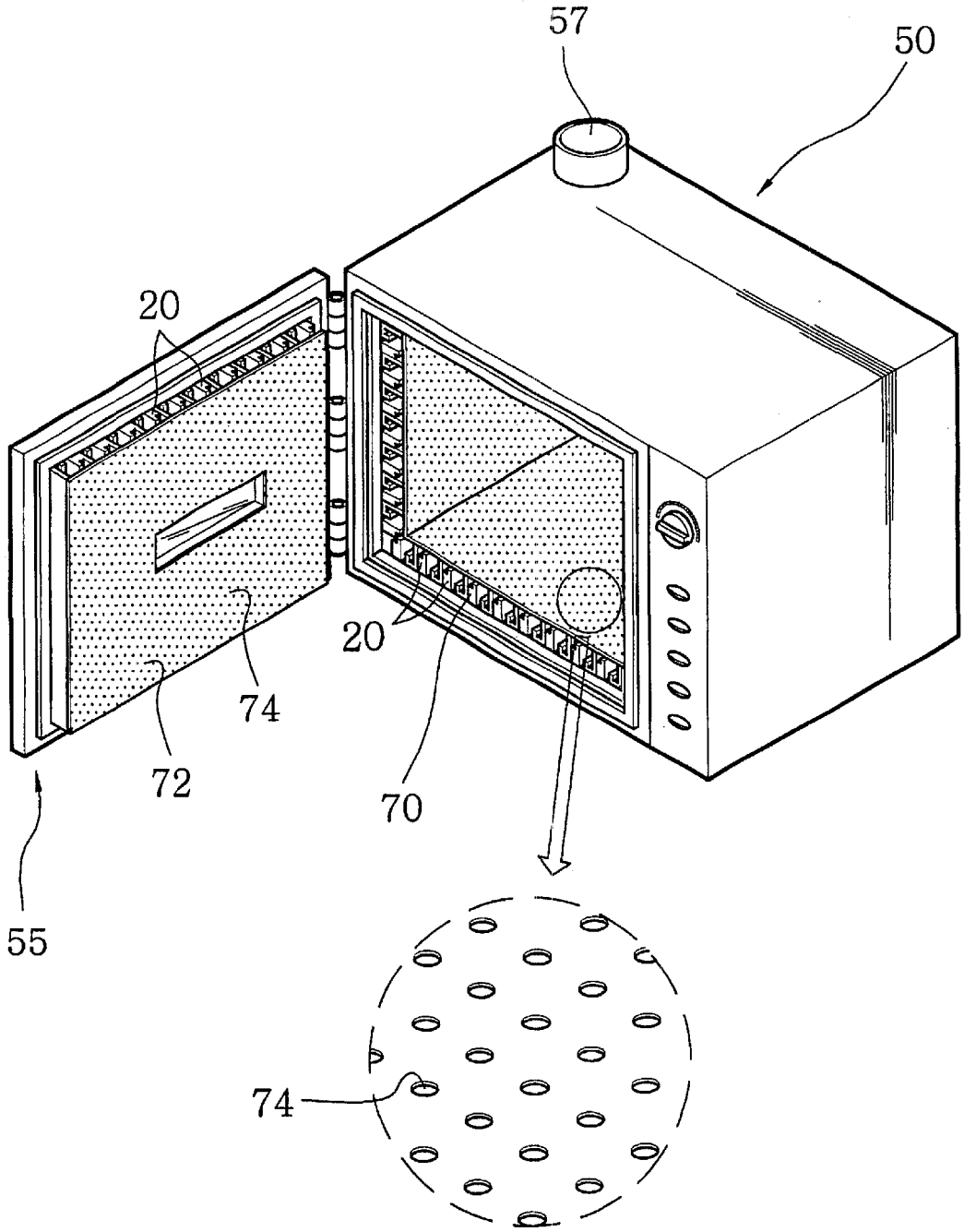
Figure 7B:
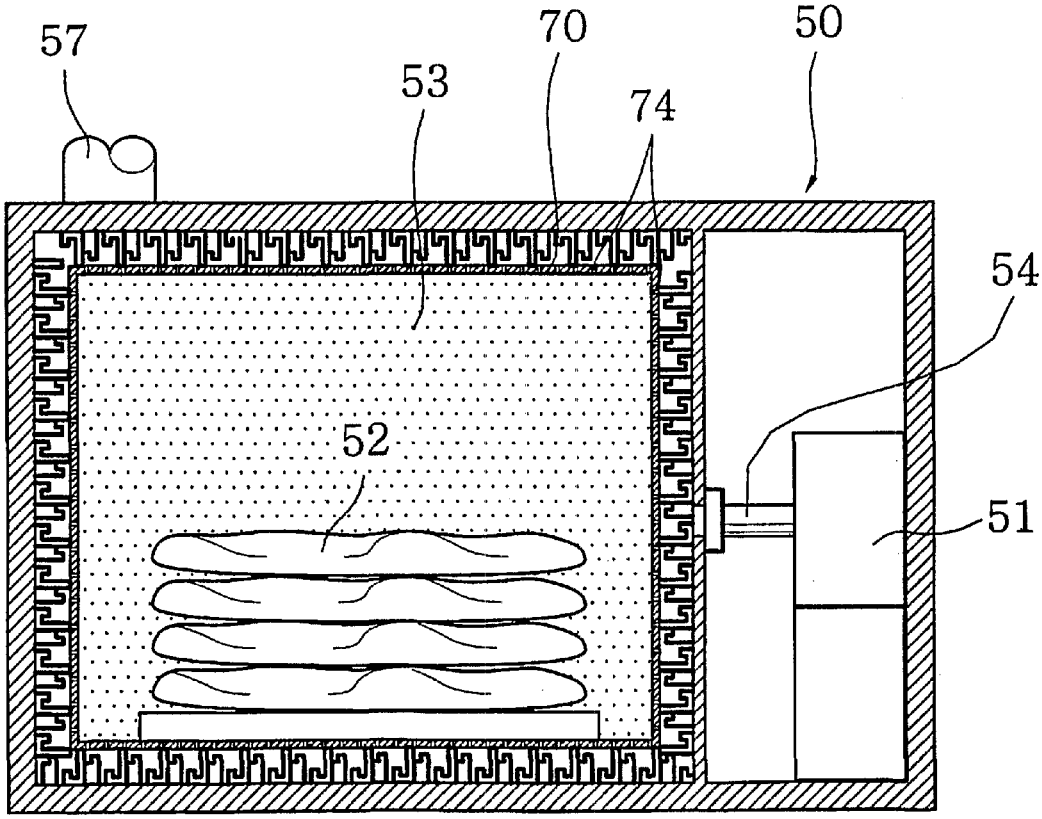

FIGS. 7*a* and 7*b* are views showing another example of the heating system with the apparatus for uniformly dispersing the microwave according to the present invention installed therein. FIG. 7*a* is a perspective view of the heating system with the door opened, and FIG. 7*b* is a sectional view of the heating system.

As shown in the figures, this example of the heating system includes an object accommodating chamber 70 made of materials such as Teflon through which the microwave can penetrates, on the inner side of the bodies 20 constituting the heating chamber 53. Each side of the object accommodating chamber 70 can be sized such that it can abut on the highest top surfaces of the reflective portions 22 of the bodies 20.

Moreover, the bodies 20 attached to the inner surface of the door 55 are also provided with an opening and closing plate 72 made of materials such as Teflon through which the microwave can penetrates, so that when the door 55 is closed, the front face of the object accommodating chamber 70 can be closed by the opening and closing plate 72.

The provision of the additional object accommodating chamber 70 in the heating chamber 53 allows the interior of the heating chamber to be easily cleaned after heating and drying the object 52.

At this time, it is preferable that the object accommodating chamber 70 be also formed with a plurality of vent holes 74 so that water vapor, smell and the like generated while heating and drying the object 52 can be discharged to the exterior through the exhausting port 57.

With such heating system of the present invention, Teflon plates having a thickness of 0.7 cm were installed at a height of 3 cm from the inner surfaces of the heating chamber 53.

Several pieces of cheese stacked one above another were placed on the Teflon plate at the bottom of the heating chamber 53. The microwave generating means 51 generated the microwave with power of 2 kW which in turn was guided through the microwave guiding means 54 into the heating chamber 53 so as to heat the pieces of the cheese. The pieces of cheese were heated for 1 minute, and temperature measurement was then performed at various points of the pieces of cheese. The temperature measurement resulted in an isothermal contour map shown in FIG. 8.

Figure 8:
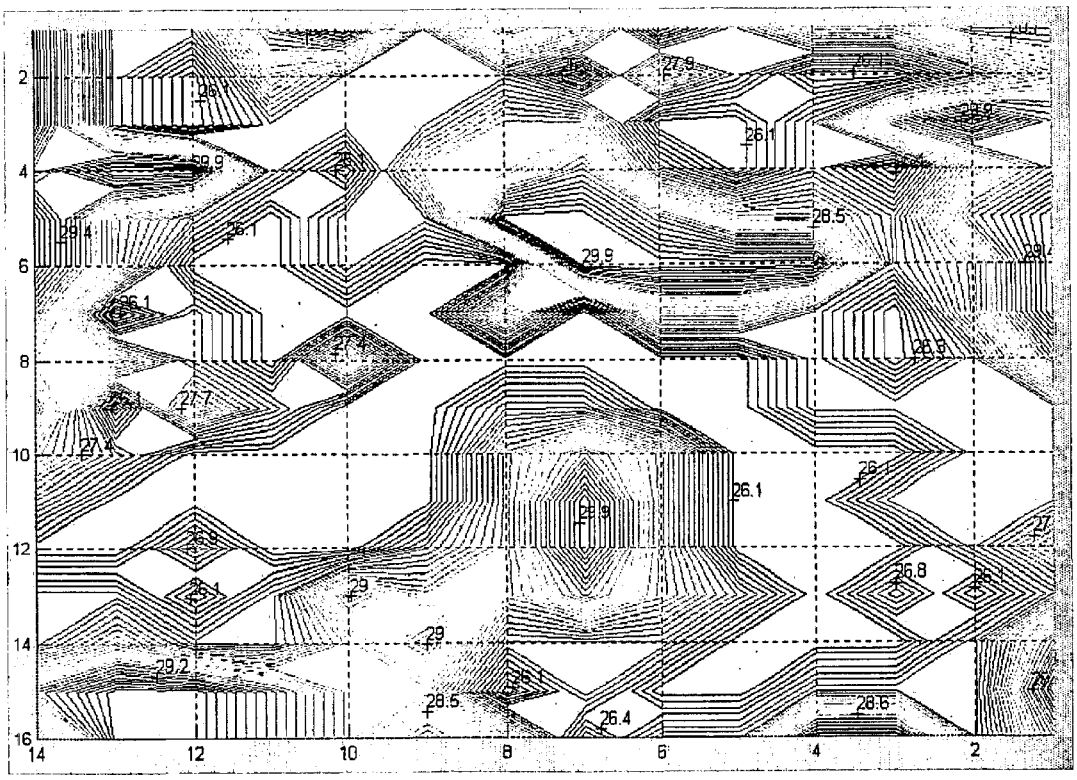
FIG. 8 is an isothermal contour map showing a result of temperature measurement after heating several pieces of cheese put in the heating system according to the present invention, for 1 minute with microwave power of 2 kW.

As shown in FIG. 8, the temperature measured at the various points of the pieces of cheese in the heating system of the present invention ranged from 26.1° C. to 29.9° C. It can be seen that a temperature difference between the maximally and minimally heated points is 3.8° C., which means that the pieces of cheese were evenly heated as a whole.

Meanwhile, although this embodiment has been described in connection with a case where an operator himself/herself puts the object 52 in the heating chamber 53 or the object accommodating chamber 57 of the heating system so as to heat and dry the object 52, the present invention is not limited thereto but may be applied to various microwave heating systems.

For instance, the bodies 20 of the present invention may be installed in a heating system wherein opposite ends thereof are opened, a predetermined object to be heated is automatically transferred by a conveyor etc., not shown in the figures, and then the microwave is prevented from leaking through the opened opposite ends, thereby uniformly dispersing the microwave and evenly heating and drying the object.

INDUSTRIAL APPLICABILITY

As described above, the present invention has dispersion characteristics by which the microwave can be uniformly propagated at all angles of reflection. Thus, according to the present invention, an object to be heated can be evenly heated and dried.

What is claimed is:

1. An apparatus for uniformly dispersing a microwave, comprising:

a body including a plurality of reflective portions which are made of materials capable of reflecting said microwave and have an identical width proportional to a wavelength of said microwave and different depths obtained under the condition that a datum plane is defined by a height from the bottom surface thereof corresponding to a value obtained by multiplying said width of said reflective portions by (prime number−1);

said width w of said reflective portions being set as 1/n (n=1, 2, 3, . . . ) times as large as said wavelength $\lambda_g$ of said microwave; and said depths $D_k$ of said reflective portions being set with respect to said datum plane according to the following equation (1):

$$D=g^n \text{ module } p,\ D_k=D\cdot W \tag{1}$$

where p is a prime number, g is the least primitive root of said prime number p, n is a natural number such as 1, 2, 3, . . . and $g^n$ module p means the remainder obtained by dividing $g^n$ by p.

2. The apparatus as claimed in claim 1, wherein top surfaces of said reflective portions are horizontal, and side surfaces of said reflective portions are vertical.

3. The apparatus as claimed in claim 1, wherein said width of said reflective portions is set as 1/4n times as large as said wavelength $\lambda_g$ of said microwave.

4. An apparatus for uniformly dispersing a microwave, comprising:

a body including a plurality of reflective portions which are made of materials capable of reflecting said microwave and have an identical width proportional to a wavelength of said microwave and different heights obtained under a condition that a datum plane is defined by the bottom surface thereof;

said width W of said reflective portions being set as 1/n (n=1, 2, 3, . . . ) times as large as said wavelength $\lambda_g$ of said microwave; and said heights $H_K$ of said reflective portions being set with respect to said bottom surface according to the following equation (2):

$$H=N^2 \text{ module } p,\ H_K=H\cdot W \tag{2}$$

where N is 0, 1, 2, . . . , p is a prime number, and $N^2$ module p means the remainder obtained by dividing $N^2$ by p.

5. The apparatus as claimed in claim 4, wherein top surfaces of said reflective portions are horizontal, and side surfaces of said reflective portions are vertical.

6. The apparatus as claimed in claim 4, wherein said width of said reflective portions is set as 1/4n times as large as said wavelength $\lambda_g$ of said microwave.

7. A heating system employing an apparatus for uniformly dispersing a microwave, comprising:

a microwave generating means for generating said microwave;

a microwave guiding means for guiding said microwave generated from said microwave generating means;

a heating chamber for dispersing said microwave guided by said microwave guiding means so as to heat and dry an object to be heated;

a door openably installed in the front of said heating chamber; and top, bottom and inner wall surfaces of said heating chamber being constructed by continuously and repeatedly forming bodies of which each includes a plurality of reflective portions which are made of materials capable of reflecting said microwave and have an identical width W proportional to a wavelength of said microwave and different depths (or heights) obtained with respect to a datum plane (or the bottom surface thereof).

8. The heating system as claimed in claim 7, wherein said width W of said reflective portions of said body is set as 1/n times as large as said wavelength $\lambda_g$ of said microwave; and said depths $D_k$ of said reflective portions of said body are set according to the following equation (3) under the condition that a datum plane is defined by a height from the bottom surface thereof corresponding to a value obtained by multiplying said width of said reflective portions by (prime number−1):

$$D=g^n \text{ module } p,\ D_k=D\cdot W \tag{3}$$

where p is a prime number, g is the least primitive root of said prime number p, n is a natural number such as 1, 2, 3, . . . , and $g^n$ module p means the remainder obtained by dividing $g^n$ by p.

9. The heating system as claimed in claim 8, wherein said bodies are formed with vent holes at a predetermined interval, said vent holes being sized such that water vapor and smell generated when an object to be heated is heated and dried are discharged through said vent holes while preventing said microwave from leaking therethrough.

10. The heating system as claimed in claim 8, wherein an object accommodating chamber made of materials through which said microwave can penetrate is contained in said heating chamber formed by said bodies.

11. The heating system as claimed in claim 7, wherein said width W of said reflective portions of said body is set as 1/n times as large as said wavelength $\lambda_g$ of said microwave; and said heights $H_K$ of said reflective portions of said body are set according to the following equation (4) with respect to said bottom surface:

$$H=N^2 \text{module } p,\ H_K=H\cdot W \tag{4}$$

where N is 0, 1, 2, 3, . . . , p is a prime number, and $N^2$ module p means the remainder obtained by dividing $N^2$ by p.

12. The heating system as claimed in claim 11, wherein said bodies are formed with vent holes at a predetermined interval, said vent holes being sized such that water vapor and smell generated when an object to be heated is heated and dried are discharged through said vent holes while preventing said microwave from leaking therethrough.

13. The heating system as claimed in claim 11, wherein an object accommodating chamber made of materials through which said microwave can penetrate is contained in said heating chamber formed by said bodies.

14. The heating system as claimed in claim 7, wherein said bodies are arranged in zigzags.

15. The heating system as claimed in claim 14, wherein said bodies are formed with vent holes at a predetermined interval, said vent holes being sized such that water vapor and smell generated when an object to be heated is heated and dried are discharged through said vent holes while preventing said microwave from leaking therethrough.

16. The heating system as claimed in claim 7, wherein said bodies are arranged in zigzags with said reflective portions positioned at a predetermined angle.

17. The heating system as claimed in claim 16, wherein said bodies are formed with vent holes at a predetermined interval, said vent holes being sized such that water vapor and smell generated when an object to be heated is heated and dried are discharged through said vent holes while preventing said microwave from leaking therethrough.

18. The heating system as claimed in claim 7, wherein said bodies are formed with vent holes at a predetermined interval, said vent holes being sized such that water vapor and smell generated when an object to be heated is heated and dried are discharged through said vent holes while preventing said microwave from leaking therethrough.

19. The heating system as claimed in claim 7, wherein an object accommodating chamber made of materials through which said microwave can penetrate is contained in said heating chamber formed by said bodies.

20. The heating system as claimed in claim 7, wherein an inner surface of said door is provided with said bodies of which each includes said plurality of reflective portions which are made of materials capable of reflecting said microwave and have said identical width proportional to said wavelength of said microwave and said different depths obtained with respect to said datum plane.

* * * * *